United States Patent [19]

Byrns

[11] Patent Number: 4,732,430

[45] Date of Patent: Mar. 22, 1988

[54] BLOW MOLDED DRAWER FRONT

[76] Inventor: James E. Byrns, 1027 2nd Ave., South, Clinton, Iowa 52732

[21] Appl. No.: 19,377

[22] Filed: Feb. 26, 1987

[51] Int. Cl.[4] ..... A47B 88/00

[52] U.S. Cl. ..... 312/330 R; 312/320

[58] Field of Search ..... 312/330 R, 347, 263, 312/257 R, 257 A, 257 SK, 140, 320; 16/124

[56] References Cited

U.S. PATENT DOCUMENTS

| | | | |
|---|---|---|---|
| 1,404,503 | 1/1922 | Williams | 312/320 |
| 1,976,118 | 10/1934 | Cruikshank | 16/124 |
| 2,499,299 | 2/1950 | Curran | 312/330 R |
| 2,842,420 | 7/1958 | Hansen et al. | 312/330 R |
| 3,129,988 | 4/1964 | Kanzelberger | 312/347 |
| 3,556,626 | 1/1971 | Schock | 312/330 R |
| 3,646,634 | 3/1972 | Fusselman | 312/330 R |
| 4,036,542 | 7/1977 | Courtwright | 312/330 R |
| 4,230,382 | 10/1980 | Wenzlick et al. | 312/330 R |
| 4,403,817 | 9/1983 | Aidar | 312/330 R |
| 4,624,509 | 11/1986 | Ramsey | 312/330 R |

FOREIGN PATENT DOCUMENTS

| | | | |
|---|---|---|---|
| 1255212 | 1/1961 | France | 312/320 |
| 103593 | 1/1942 | Sweden | 312/320 |

*Primary Examiner*—Victor N. Sakran

*Attorney, Agent, or Firm*—Thomas J. Greer, Jr.

[57] ABSTRACT

A drawer construction including a drawer front and a drawer frame, wherein the drawer front is a unitary, hollow, blow-molded thermoplastic member and the drawer frame is of sheet metal. The drawer frame is defined by a bottom wall, a rear wall and two side walls. The front of the bottom wall is bent upwardly ninety degrees, and the free edge of this bent portion is gripped by spaced, downwardly extending tabs, the latter being integral with the drawer front. Similarly, the front portions of the drawer frame side walls are bent inwardly ninety degrees and each upper free edge portion thereof is gripped by a respective tab integral with the drawer frame. The drawer front and drawer frame are held together in correct relationship by fasteners extending from the drawer frame into the rear wall portion of the drawer front. This drawer front tab and frame engagement transmits most of the drawer opening force from the drawer front to the drawer frame, only a small portion of the opening force being transmitted from the front to the frame by the fasteners. This arrangement precludes the often encountered problem of the fasteners eventually rupturing the relatively thin plastic wall of the drawer front.

4 Claims, 5 Drawing Figures

BLOW MOLDED DRAWER FRONT

BACKGROUND OF THE INVENTION

This invention relates to a drawer construction and more particularly to a drawer construction wherein the drawer front is a unitary and hollow blow-molded thermoplastic member. The drawer frame is formed of sheet metal and has a bottom wall, two side walls and a rear wall. In attaching the drawer frame to the drawer front, the forward ends of the side walls and of the bottom wall are bent approximately ninety degrees, and fasteners are placed in these bent portions and extend into the relatively thin walls of the drawer front.

In attempting to obtain the benefits of the economy of a thermoplastic, blow-molded drawer front, there has been in the past the problem of fasteners pulling away from or rupturing the relatively thin thermoplastic walls of the drawer front to which they are attached. Each time the drawer front is pulled to open the drawer from its cabinet or housing, there is a force transmitted through the fastening elements to the wall of the hollow drawer front. In time, such repeated forces often cause rupture of the thin wall.

SUMMARY OF THE INVENTION

According to the practice of this invention, a unitary drawer front, formed from a thermoplastic material and blow-molded so as to define a generally hollow and elongated, rectangular member, is provided with a plurality of integral and overhanging tabs. These tabs define, with associated rear portions of the drawer front, a recess. Each of these recesses receives the free edge of an associated bent portion of the side and bottom walls of the drawer frame. The fasteners (themselves conventional) extend from the bent portions of the side and bottom walls of the drawer frame into the hollow drawer front. By virtue of the overhanging tabs, when the drawer is opened, the pulling force on the drawer front is transmitted to the drawer frame mainly by the tabs. By virtue of this construction, pulling forces of the fasteners on the relatively thin walls of the drawer front are reduced to a minimum, with the pulling force mainly being taken by the tabs, with the result that the usual tearing or rupturing of the relatively thin walled plastic of the drawer front is inhibited.

The tabs also reduce the number of fasteners required for assembly of the drawer. Often, the purchaser must assemble the drawer and hence lessening the number of fasteners required facilitates assembly.

DESCRIPTION OF THE INVENTION

Figure 1:
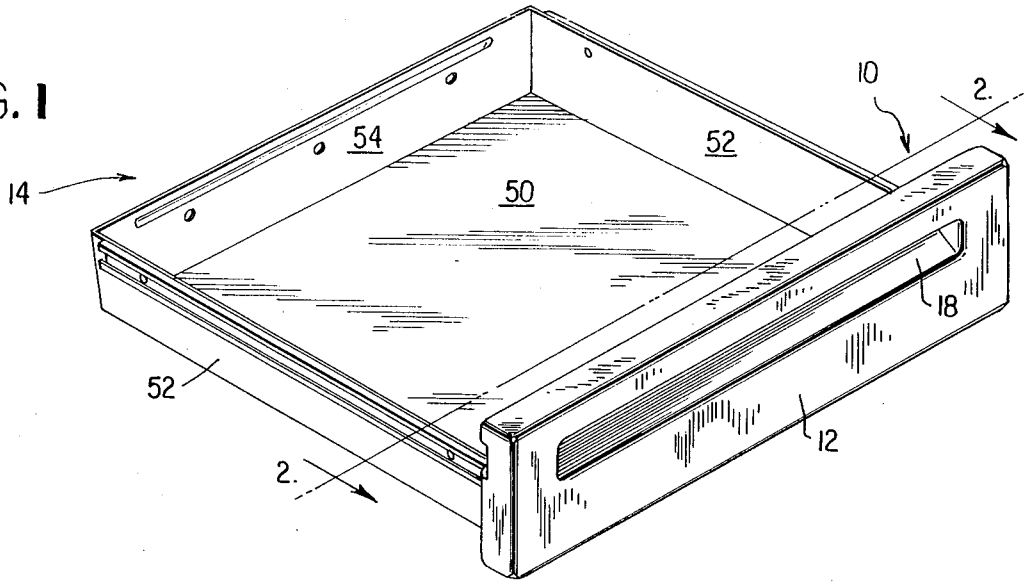
FIG. 1 is a perspective view of drawer of this invention, showing the drawer front and the drawer frame.

Referring now to FIG. 1 of the drawings,the numeral 10 denotes the drawer and the numeral 12 denotes the drawer front of this invention, the latter fashioned from any one of a number of known thermoplastic materials and is blow-molded so as to define a generally hollow interior. The drawer front 12 is preferably of a unitary or one-piece construction. In FIG. 1, the forward end of the drawer will refer to the lower right portion of the figure while the rearward end of the drawer corresponds to the upper left portion of the figure. The forward portion or surface of the drawer front 12 is provided with an elongated recess denoted by the numeral 18, this recess having an upwardly slanting wall in its interior, preferably provided with grooves to increase friction with the fingertips of the user, and extends substantially the entire length of the drawer front 12. The drawer frame is fashioned from sheet metal, and is defined by a bottom wall 50, a pair of side walls 52, and a rear wall 54. Except for the front portion of the sheet metal drawer frame, the drawer frame is of conventional construction and may be provided with the indicated roller receiving elements on the side walls.

Referring now to FIGS. 2–5, the numeral 28 denotes the upper, rearward portion of drawer front 12, the lower portion of the rear of the drawer front being denoted by the numeral 32 which is in the form of a bulge or strengthening rib. A plurality of overhanging tab elements 36, integral with rib 32, depend downwardly and define spaces between the free downwardly depending tabs and the adjacent wall portions of the drawer frame 12. The numeral 38 denotes lateral extensions of rib 32, while the numeral 40 denotes drawer wall rear portions against which bends 56 and 60 (to be described) abut in surface contact.

The numeral 56 denotes an upward bend in the forward portion of bottom wall 50, the bend extending at approximately ninety degrees to the plane of the bottom wall. The uppermost portion of bend 56 is termed a free edge. It is seen that the free edge of bend 56 is snuggly engaged by the lower ends of two tabs 36. Similarly, the forward end of each drawer frame side wall 52 terminates in a bend 60, generally at ninety degrees with respect to the plane of its respective side wall, with the upper portion of this bend having a free edge which fits beneath and is snuggly engaged by a corresponding tab 36. Conventional fastening elements 64 having bellows portions 66 (see FIGS. 3–5) extend from pre-cut holes in bends 56 and 60, through corresponding pre-formed holes in the bottom portion 40 of a rear wall portion of drawer front 12, for the purpose of properly positioning the drawer front to the drawer frame. Fastening elements 64, ideally, receive very little tensile force when the drawer front is pulled, serving only to properly position the frame to the drawer front. The specific type of fastening elements employed forms no part of this invention.

Figure 4:
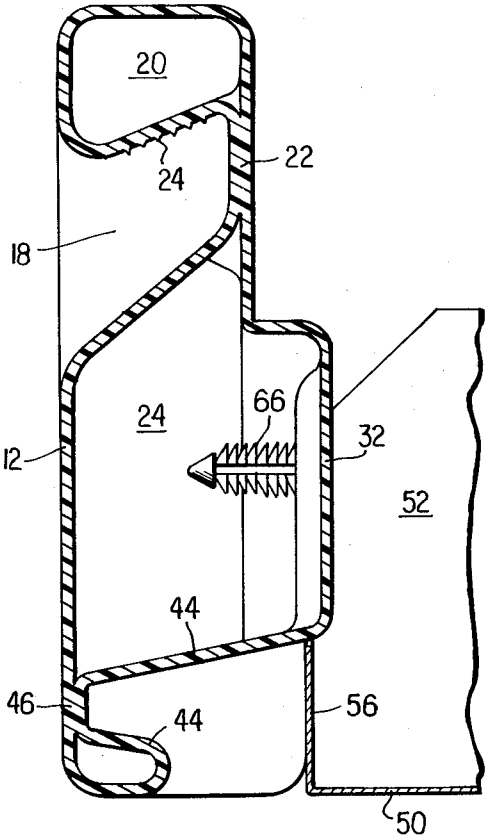
FIG. 4 is a cross-section taken along section 4—4 of FIG. 2.

If desired, one or more struts having walls 44 and weld portions 46 may be employed at the bottom of the drawer front 12 (see FIGS. 2 and 4) for reinforcement. Similarly, as shown at FIGS. 3 and 4, the forward portion of drawer front 12 is welded (a fusing technique known in the thermoplastic art) to the rear portion 28, with longitudinal ribs 24 serving to define finger engaging surfaces for the internal handle 18. Additionally, the rear portion of drawer front 12 may be provided at its ends with recesses 30 to assist in pulling out the drawer.

Figure 2:
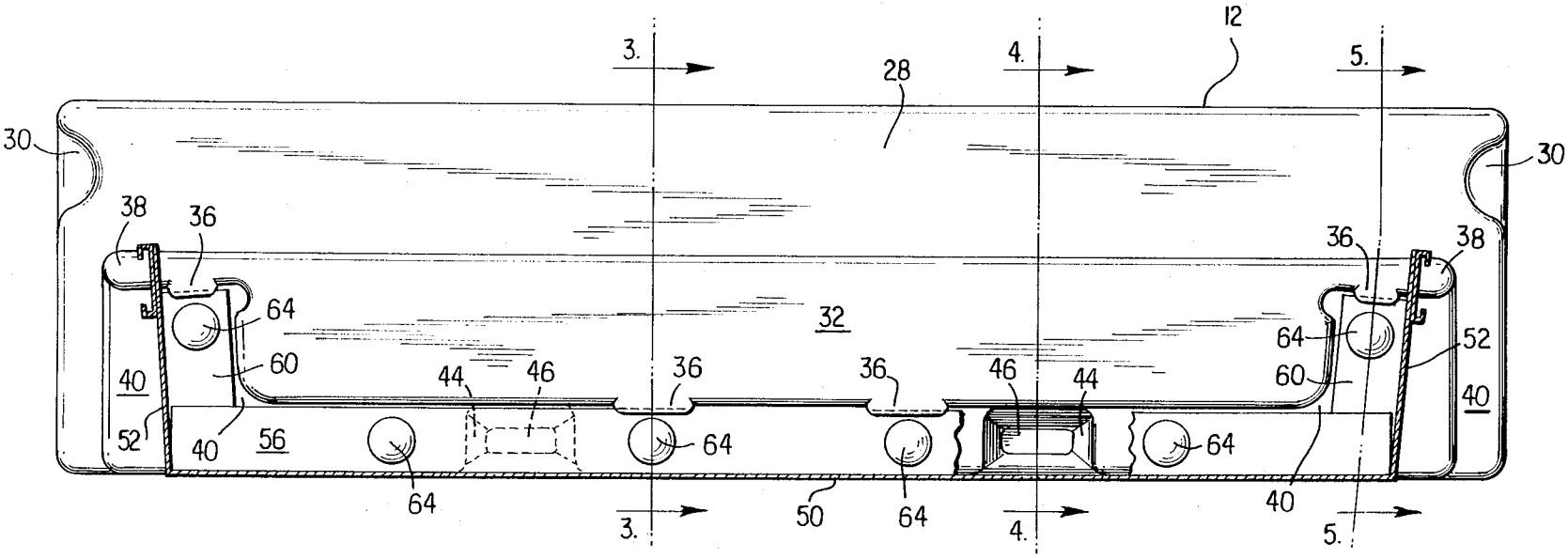
FIG. 2 is a view taken along section 2—2 of FIG. 1 and shows the rear portion of the drawer front and its connections with the drawer frame.
Figure 5:
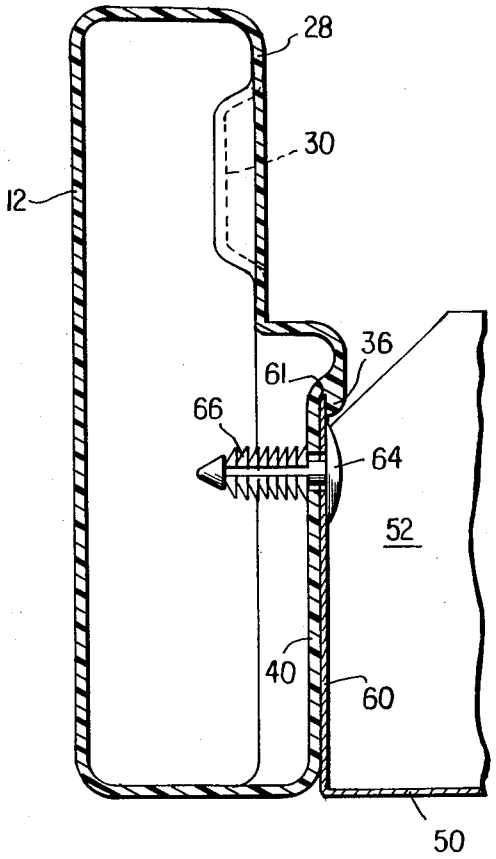
FIG. 5 is a cross-section taken along section 5—5 of FIG. 2.
Figure 3:
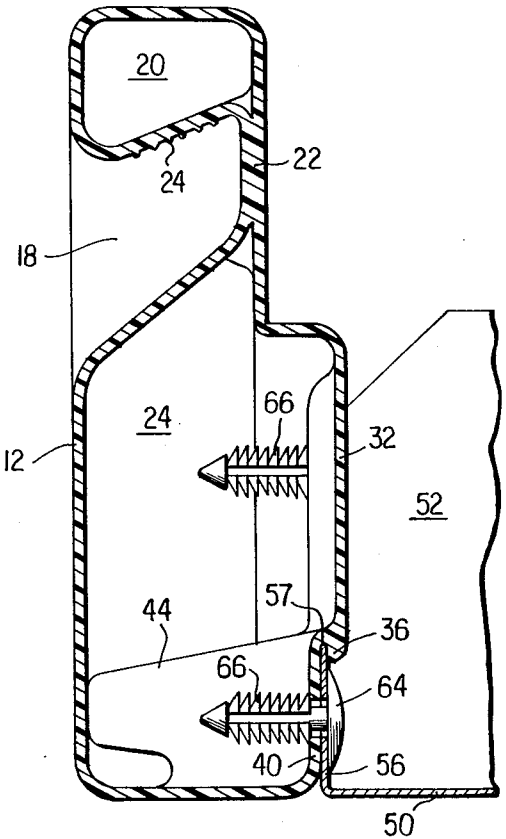
FIG. 3 is a cross-section taken along section 3—3 of FIG. 2.

Referring now particularly to FIGS. 2, 3 and 5, it is seen that the free edge 57 of each bottom wall bend 56 is engaged by a respective overhanging tab 36, while two similar and spaced apart overhanging tabs 36 engage the free end 61 of bend 60. The engagement between these free edges and the corresponding tabs serves to transmit the pulling force from the drawer front (from right to left in FIGS. 3–5) to the sheet metal drawer frame, thereby insuring that little tensile force is transmitted from the drawer frame to the fastening elements 64. This inhibits rupture of the relatively thin plastic walls by the fastening elements and hence lengthens the useful life of the drawer front.

The tabs 36 have been illustrated as directed downwardly to engage the upwardly extending free edges of bends 54 and 60. Clearly, the bends 60 could be directed outwardly instead of inwardly as shown and bend 56 could extend downwardly. Further, the tabs 36 which engage drawer frame bends 60 could engage the side free edges as well as or instead of the illustrated upper free edge portions of these bends.

The bottom wall of the drawer frame has been shown as aligned with the bottom of the drawer front. It is believed evident that this is only one of many possible relative elevations of the bottom 50 to the drawer front 12.

Further, the number of internal reinforcements, such as welds 22 and 46, as well as the number, location and shape of reinforcing ribs (such as 32) may be varied with the strength requirements of the drawer front 12. In general, the larger the drawer front, the greater the requirement for its strengthening. Different rib and weld requirements are readily effected by suitable die configurations and weld formation, such techniques being well known in the blow molding art.

What is claimed is:

1. A drawer construction including a generally rectangular, elongated drawer front having a forward portion and a rear portion, a sheet metal drawer frame including a bottom wall, a rear wall and two side walls, means for positioning the drawer frame to the drawer front, at least one of said bottom wall and side walls having a bend adjacent the rear portion of said drawer front, said bend having a free edge, the rear portion of said drawer front rigidly carrying at least one tab which overhangs and engages said bend free edge, whereby when the drawer front is pulled forwardly, the drawer frame will move with it, said means for positioning the drawer frame to the drawer front defined by a fastener extending from said bend and extending through and anchored to the rear portion of said drawer front, said drawer front being of a one-piece, blow molded thermoplastic construction having a generally hollow interior, the rear portion of said drawer front having a strengthening rib from which said tab integrally extends, said free edge of said bend snugly engaged between said tab and an associated portion of the rear portion of the drawer front, whereby pulling forces of the fastener on the walls of the drawer front are reduced to a minimum, with the pulling force mainly being taken by the tab, with the result that tearing or rupturing of the plastic from which the drawer front is formed is inhibited.

2. The drawer construction of claim 1 wherein a part of the forward portion of said drawer front extends in a rearward direction and meets and is welded to a part of the rear portion of said drawer front, to thereby define an internal cavity, said cavity defining a handle to pull the drawer and wherein said fastener extends through pre-formed holes in both said bend and in a rear wall portion of said drawer front.

3. The drawer construction of claim 1 wherein each of said side walls and said bottom wall is provided with a said bend, each bend being snugly engaged by a respective said tab integrally carried by said strengthening rib adjacent the rear portion of said drawer front, each bend having a said fastener extending through it.

4. A one-piece drawer front for a drawer, the drawer front being formed of a thermoplastic material and being blow molded so as to define an elongated, generally hollow rectangular element having a front wall and a rear wall, the front wall having a hollow and elongated recessed handle defined by a weld between a portion of said front wall and a portion of said rear wall, said rear wall having a plurality of integral tabs each of which defines a space between it and said rear wall whereby free edge bend portions at the forward portion of a drawer frame can be inserted into the tab spaces, said tabs integrally extending from a strengthening rib on said rear wall and extending substantially parallel to said rear wall, and a pre-formed hole in said rear wall adjacent each said tab, said hole adapted to receive a fastener.

* * * * *